US005444454A

United States Patent [19]

White

[11] Patent Number: 5,444,454

[45] Date of Patent: Aug. 22, 1995

[54] MONOLITHIC MILLIMETER-WAVE PHASED ARRAY

[75] Inventor: Joseph F. White, Boston, Mass.

[73] Assignee: M/A-COM, Inc., Lowell, Mass.

[21] Appl. No.: 870,240

[22] Filed: Jun. 3, 1986

Related U.S. Application Data

[63] Continuation of Ser. No. 503,430, Jun. 13, 1983, abandoned.

[51] Int. Cl.[6] ..... H01Q 19/06

[52] U.S. Cl. ..... 343/754; 342/368

[58] Field of Search ..... 343/768, 700 MS, 909, 343/754, 755, 756, 775; 342/3352, 353, 368

[56] References Cited

U.S. PATENT DOCUMENTS 3,708,796 1/1973 Gilbert ..... 343/754
3,959,794 5/1976 Chrepata et al. .
4,297,708 10/1981 Vidal .
4,320,404 3/1982 Chekroun .

*Primary Examiner*—Theodore M. Blum
*Attorney, Agent, or Firm*—Wolf, Greenfield & Sacks

[57] ABSTRACT

Microwave apparatus for altering the phase-front of microwave energy propagating in a predetermined path and in which there is provided a panel having a plurality of electrically-conductive leads extending substantially parallel to the electric vector of the wave, each of these leads is lengthwise divided into sections. A semiconductor junction is formed in the semiconductor material at each end of each section of lead. Each pair of confronting junctions together with the semiconductor material therebetween provide a surface oriented semiconductor diode switch. A switching voltage is applied to each of the leads so as to render at least some of the diodes in each of the leads simultaneously either conductive or non-conductive, thereby allowing each of the leads to be electrically either divided into said sections or continuous throughout at least a portion of its length.

14 Claims, 1 Drawing Sheet

MONOLITHIC MILLIMETER-WAVE PHASED ARRAY

This application is a continuation of Ser. No. 06/503,430 filed Jun. 13, 1983, now abandoned.

INTRODUCTION

This invention relates in general to altering the phase-front of microwave energy propagating in a path. Such capability is desirable to shift the path direction, or to alter the curvature of the phase front, as principal examples. Arrays of phase-shifters have been used for this purpose, and the prior art that is at present known to be most-nearly pertinent to the invention is U.S. Pat. No. 3,708,796 and a corresponding publication in *Microwave Journal,* February 1981, pp. 45–53, "RADANT: New Method of Electronic Scanning" by Chekroun et al. This prior art discloses phase shifter structures on dielectric panels which are transparent to microwave energy which are practical for S and X-band antennas and lenses, for example, but which become impractical for use in apparatus intended for use at millimetric wave frequencies extending roughly from 30 $GH_z$ to 300 $GH_z$, for example, of 35 $GH_z$, 94 $GH_z$ and higher, which frequencies are now recognized to be useful.

The present invention permits the realization of coherent microwave communication and/or radar systems with antennas of practical narrow beam widths, a few degrees or less, which antennas may be electronically steered (as by phased array techniques) yet be of the dimensions of flashlight lenses, dimensions not hitherto practical by conventional electronic phased array means prior to this invention.

GENERAL NATURE OF THE INVENTION

The present invention achieves a new form of lens or phase shifter employing monolithic circuit techniques to form a network of surface-oriented semiconductor diodes between short sections of electrically-conductive leads which can be semiconductor dielectric material as to be practically useful to alter the phase front of millimeter waves in the above-mentioned higher-frequency ranges. The length of each lead between control diodes normally does not exceed one half the wavelength in the panel of the millimeter waves propagating through the panel. The dielectric panel can be made of silicon, which functions both as an integrated-circuit medium and as a dielectric which is transparent to millimeter wave energy; alternatively, for example, the dielectric panel can be silicon-on-sapphire (SOS), to achieve lower insertion loss. Other materials such as gallium arsenide, germanium or indium phosphide, are also useful to provide the panel of semiconductor material. The diodes are desirably PIN diodes formed at the surface of the panel by known deposition methods. Alternatively, any semiconductor switching device could be used, for example, field effect transistors (FET's) used as switches. However, for the purposes of description of a presently preferred embodiment of the invention, the PIN diode embodiment will be described.

Thus, at the respective confronting ends of two sections of a conductive lead there will be formed by known doping processes a P+ and an N+ junction, and the semiconductor material in which they are formed will be a high-resistivity silicon, thereby creating a PIN diode. Thermal diffusion or high-energy injection of appropriate dopants through the surface can be used.

Alternatively, epitaxial growth of the entire semiconductor may be used to form the junctions and the high-resistivity regions within the semiconductor material. The diode is oriented in the surface (surface-oriented) or it may be built of a vertical geometry within the silicon with conductive patterns which render it equivalent to a surface oriented device and its state of conducting or non-conducting can be controlled by a voltage applied to the ends of the conductive lead or to portions of the leads immediately contiguous to the individual PIN diodes if individual bias control is needed. The corresponding bias lead pattern is not shown. Non-limiting embodiments of the invention are illustrated in the accompanying drawings and described in the description that follows.

DETAILED DESCRIPTION OF THE DRAWINGS

Figure 1:
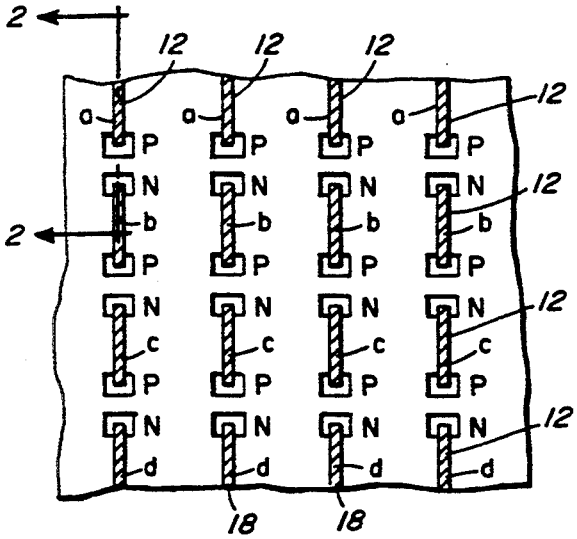
FIG. 1 shows a panel incorporating a monolithic array of conductors and diodes according to the invention.
Figure 2:
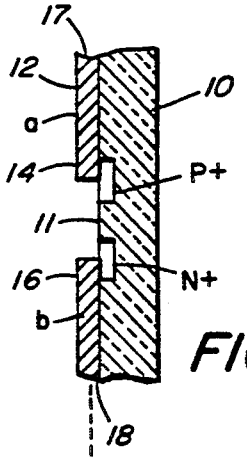
FIG. 2 is a slightly-enlarged section on line 2—2 of FIG. 1.

As is shown in FIGS. 1 and 2, the panel 10 has on one surface 11 an array of electrical conductors 12, which can be "beam leads" formed by monolithic semiconductor techniques. The leads 12 are each separated into sections a, b, c, d, etc., each preferably not longer than half the wavelength of the microwave energy propagating through the panel 10. Respective P and N junctions are provided at the confronting ends of successive sections. Each junction is formed in the panel 10, which is used as a semiconductor substrate into which an appropriate dopant is diffused to form respectively a P+ diffusion junction at the end 14 of section (a) and an N+ diffusion junction at the confronting end 16 of the next adjacent section (b). For this use as a substrate the panel 10 has a suitably high resistivity to form a PIN diode with the P+ and N+ junctions. As is illustrated in FIG. 2, each such PIN diode is realized completely within the panel 10; this permits placing a pair or more of panels very close together in the path of propagation of the microwave energy, with advantages in constructing lens arrays as well as satisfying the close panel spacing at millimeter wave frequencies of less than one half wavelength that is necessary for such lens arrays. Control voltage to a bias the diodes in each conductor 12, conductive or non-conductive, can be applied with the simplest bias execution to the ends 17 and 18 of each conductor, but bias introduction is also possible at intermediate positions of each conductor if more individual separate bias access to the diodes is desired, for example, so as to enhance switching speed of the diodes, or to bias fewer than all of the diodes in each or some conductors.

In a lens or phase shifter capable of altering the phase front of microwave energy in the frequency range from 90 to 100 $GH_z$ the sections a, b, c, d, etc., of leads 12 should have a length of not longer than about 1.5 mm., and the leads 12 should be spaced not more than about 1.5 mm. apart.

Figure 3:
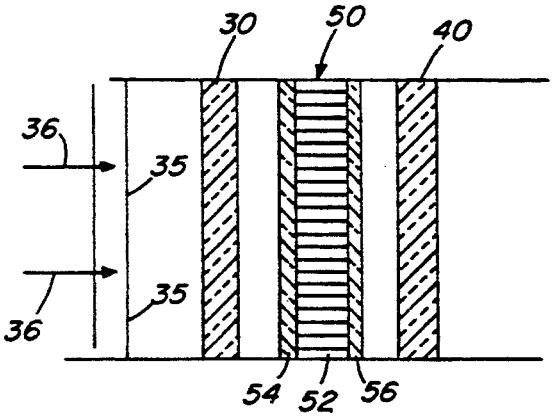
FIG. 3 is an axial section through a lens array.
Figure 4:
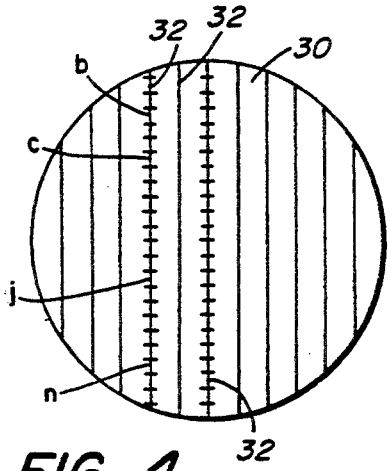
FIG. 4 is a front view of a lens panel taken on line 4—4 in FIG. 3.

FIGS. 3 and 4 illustrate a lens array of two panels 30 and 40 like that shown in FIGS. 1 and 2. FIG. 4 shows schematically the phase-shifter array of one of the panels 30; it is similar in the other panel 40. An array of densely-packed electrical conductors 32 is broken into sections a . . . "n," etc., and diodes 34 are provided in each conductor between successive sections, as in FIGS. 1 and 2.

In FIG. 3 each panel 30, 40 is a constituent of a complete lens capable of altering the phase front 35 of a wave propagating in a path represented by arrows 36 by an amount of up to one wavelength of the propagating microwave energy, said wavelength range of control being recognized as sufficient to accommodate any desired extent of beam steering. The first panel imposes a first incremental alteration on the phase front, followed by a second incremental alteration that can be imposed by the succeeding panel 40.

The surface-oriented diode structure shown in FIG. 2 allows the panels to be placed physically as close together as is desired; the space shown between them in FIG. 3 is for illustration only, and not a limitation on the disclosure. Should there be a problem with scattering of wave energy between two successive lens panels 30 and 40, a collimator 50 can be located between them. The collimator is a honeycomb structure 52, preferably made of, or surface-coated with, an electrically conductive material, supported between two dielectric sheets 54, 56.

Figure 5:
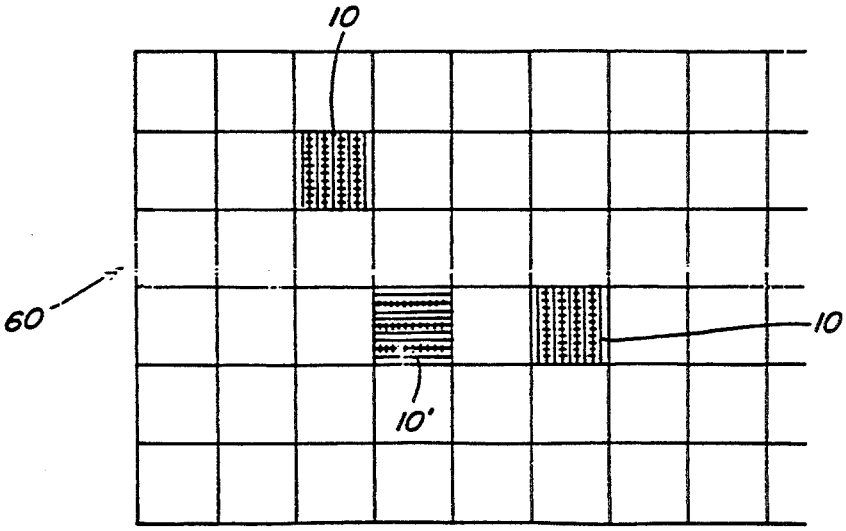
FIG. 5 illustrates a mosaic of panels assembled into a larger structure as would be appropriate when a lens diameter larger than individual silicon slices is desired.

Integrated-circuit panels according to the invention can be made in various sizes. However, for economic reasons it may be desirable to limit the size of a panel. FIG. 5 shows an array 60 of panels 10, for operating on a large area of wave front. Recognizing that each panel 10 can have a phase-shifter packing density which has heretofore been unachieavable, small panels can be provided in the array 60, and if desired some of them such as panel $10^1$ could be oriented with their conductors perpendicular to the conductors of the other panels. This would provide an antenna array, for example, with the capability of acting on cross-polarized waves.

I claim:

1. Microwave apparatus for altering the phase front of a wave of microwave energy propagating in a path comprising a panel of semiconductor dielectric material intended to be located in said path so as to intercept said phase front, said panel having a thickness in the direction of the microwave energy propagating path that is small in comparison in the panel cross-section, said panel including a plurality of electrically-conductive leads extending substantially parallel to the electric vector of said wave when said panel is so located, each of said plurality of electrically-conductive leads being separated into a plurality of lead sections with adjacent lead sections spaced from each other and having confronting ends, said lead sections being carried on a surface of said semiconductor material that extends orthogonal to the microwave energy propagating path, a semiconductor junction formed in said semiconductor material bridging between confronting ends of adjacent lead sections each pair of confronting ends of each lead section together with the semiconductor material between them constituting effectively a surface-oriented semiconductor diode switch, said semiconductor junction being a localized junction, each said semiconductor junction include a P-type semiconductor material and an N-type semiconductor material, said lead sections each having one end coupled to said P-type semiconductor material and the other end coupled to said N-type semiconductor material and means to apply switching voltage to each of said leads so as to render at least some of the diodes in each of said leads simultaneously either conductive or non-conductive, thereby allowing each of said leads to be electrically either divided into said sections or continuous throughout at least a portion of its length.

2. Apparatus according to claim 1 in which said junctions of each diode are formed monolithically in said semiconductor material, so as to provide integrated surface-oriented PIN diodes on said surface.

3. Apparatus according to claim 2 in which said semiconductor material is high-resistivity silicon and said junctions are formed by a process selected from thermal diffusion or high energy injection of appropriate dopants through said surface, or the epitaxial growth of the whole semiconductor so as to form said junctions and high resistivity regions within said semiconductor material.

4. Apparatus according to claim 1 in which said semiconductor material is selected from silicon, silicon-on-sapphire gallium arsenide, germanium, or idium phosphide.

5. Apparatus according to claim 1 in combination with microwave collimating means adjacent said panel for constraining said wave to propagate in said path in the vicinity of said panel.

6. Apparatus according to claim 2 comprising a plurality of said panels in an array intended to be positioned across said path.

7. Apparatus according to claim 1 in which said sections have a length no longer than about one and one half millimeters (mm) so as to be capable of altering the phase front of microwave energy in the frequency range from 90 to 100 $GH_z$.

8. Apparatus according to claim 7 in which said panel includes a plurality of said leads spaced not more than about one and one half mm apart.

9. Apparatus according to claim 1 including means to bias all of the diodes in each of said leads simultaneously either conductive or non-conductive so as to divide each of said leads into said sections or to render each of said leads electrically conductive throughout its length.

10. An array of panels according to claim 1 comprising a first plurality of said panels in which said leads are oriented in a first direction and a second plurality of said panels in which said leads are oriented in a second direction that is substantially different from said first direction.

11. Apparatus according to claim 1 wherein the localized junction is disposed entirely between adjacent lead sections.

12. Apparatus according to claim 1 wherein each semiconductor junction is disposed substantially entirely between confronting.

13. Apparatus according to claim 1 wherein each lead is of elongated shape and is separated along its elongated axis into the spacedly disposed lead sections.

14. Apparatus according to claim 13 wherein each of the plurality of leads are spaced apart in a first direction and said separated lead sections are disposed in a second direction with said first and second directions being orthogonal to each other.

* * * * *